United States Patent [19]

White

[11] Patent Number: 4,630,829

[45] Date of Patent: Dec. 23, 1986

[54] COMPACT GOLF SWING TRAINING AND PRACTICE DEVICE

[76] Inventor: Arthur A. White, P.O. Box 10396, Santa Ana, Calif. 92711

[21] Appl. No.: 717,966

[22] Filed: Mar. 29, 1985

[51] Int. Cl.[4] ..... A63B 69/36

[52] U.S. Cl. ..... 273/186 A; 250/237 R

[58] Field of Search ..... 273/183 A, 186 R, 186 A; 250/237 R

[56] References Cited

U.S. PATENT DOCUMENTS

| | | | |
|---|---|---|---|
| 3,393,323 | 7/1968 | Breuning | 250/237 R |
| 3,601,408 | 8/1971 | Wright | 273/186 R |
| 4,254,956 | 3/1981 | Rusnak | 273/186 RA |

*Primary Examiner*—Leo P. Picard

*Attorney, Agent, or Firm*—Morland C. Fischer

[57] ABSTRACT

A relatively low cost, battery powered golf swing training and practice device by which a golfer may ascertain various characteristics, such as club head speed and elapsed swing time, regarding the swing of his golf club. The present training and practice device is both compact and lightweight to advantageously permit portable operation at in and out-of-doors locations. The present device includes a unique photodetector and light trap system arranged to reliably sense the movement of a golfer's club head during a backswing and downswing. The operation of the present device is controlled by a microprocessor, so that information regarding a golfer's swing can be efficiently computed and accurately indicated at an associated printer and/or digital display.

14 Claims, 8 Drawing Figures

PRINTER
+5v
PRINTER CONTROLLER
DISPLAY
DISPLAY
DRIVER
DRIVER
LOW BAT DETECT
JUMPER
MICROPROCESSOR
74
EA
RESET
INT
DB0-7
STOP
START
BUFFER
BUFFER
PULL-UP RESISTORS
COUNTER
CLR
KEYBOARD
STOP DETECTOR
START DETECTOR

COMPACT GOLF SWING TRAINING AND PRACTICE DEVICE

BACKGROUND OF THE INVENTION

1. Field of the Invention

This invention relates to a portable, microprocessor controlled golf swing training and practice device having an improved optical detection system, whereby certain characteristics regarding a golfer's swing, such as, for example, club head speed and elapsed swing time, can be efficiently sensed and accurately indicated at an associated printer and/or digital display.

2. Background Art

In my U.S. Pat. No. 4,477,079, issued Oct. 16, 1984, a novel golf swing training and practice device was disclosed by which a golfer can ascertain various characteristics, such as club head speed and elapsed swing time, regarding the swing of his golf club. A pair of photodetectors are arranged in spaced alignment with one another so as to receive horizontal and parallel beams of light and thereby define a measuring zone through which the golfer's club is passed during a swing. This training and practice device includes means for both computing the golfer's club head speed (through the measuring zone) and elapsed swing time and comparing the golfer's actual club head speed with an optical pre-selected speed.

Golf swing training and practice apparatus, other than that described in my aforementioned patent, are available. However, such conventional apparatus are typically characterized by several shortcomings. For example, the means for sensing and computing club head speed and/or swing time is generally complicated. More particularly, some conventional apparatus include arrays of sensors, lamps, and lenses to monitor club head position, attitude, direction, slice, hook, and the like characteristics regarding a club swing. Other conventional apparatus require either cumbersome mats or large stationary platforms on which the golfer must stand to practice his swing. These platforms are not easily portable and are, therefore, generally limited to indoor use. Still other apparatus utilize readout means which are not conveniently positioned so as to permit easy visual access by the golfer. What is more, the readout is often difficult to visualize, especially in bright daylight. Yet other conventional apparatus include certain sensors which require that either the golfer's club head be made of a magnetic material or that a strip of adhesive backed magnetic material be attached to the club head. Other sensing means are responsive only to the swing of a right-handed golfer.

It will therefore be apparent that as a consequence of the foregoing disadvantages, the conventional golf swing training and practice apparatus are generally undesirable because of one or more of their relatively high cost, complexity, difficulty in operation and use, requirement for special equipment, unsuitability as to all (e.g. left-handed) golfers, and lack of portability, so as to prevent convenient use at both indoor and outdoor locations.

SUMMARY OF THE INVENTION

Briefly, and in general terms, a relatively low cost and compact golf swing training and practice device is disclosed by which either a left or right-handed golfer may ascertain various characteristics, such as, for example, club head speed and total swing time regarding his golf swing. The timing and practice device is battery powered to conveniently permit portable operation both in and out-of-doors.

The present device includes an optical photodetector system by which to sense the movement of the golfer's club head. The photodetector system comprises first and second pairs of photodetectors (e.g. phototransistors), which pairs are in spaced alignment with one another to define a hitting zone through which the golfer swings his club. Each one of a pair of photodetectors is positioned in vertical alignment with the other to reliably sense the movement of the golfer's club therepast. A unique light trap configuration is arranged with each photodetector to intercept reflected ambient light signals which could otherwise adversely effect the responsiveness of the photodetectors to the movement of a club head through the measuring zone.

Operation of the present device is controlled by means of a microprocessor. The photodetector system provides output pulses to the microprocessor whenever a golfer's club enters or leaves the measuring zone. The microprocessor is adapted to distinguish between a practice waggle and an actual backswing and downswing through the measuring zone. The microprocessor is interconnected with a high speed counter so that the total elapsed time of the golfer's swing may be measured and the club head speed (just prior to striking a golf ball) computed. The microprocessor is also interfaced with a printer and a pair of digital displays, whereby information regarding the golfer's club head speed and swing time may be permanently recorded (by the printer) and/or temporarily indicated (at the displays). The golfer may provide certain additional information (e.g. such as the present date and type of club being used) to the microprocessor by means of an associated keyboard, so that such information may be printed and/or displayed along with the information regarding the golfer's swing.

DESCRIPTION OF THE PREFERRED EMBODIMENT

Figure 1:
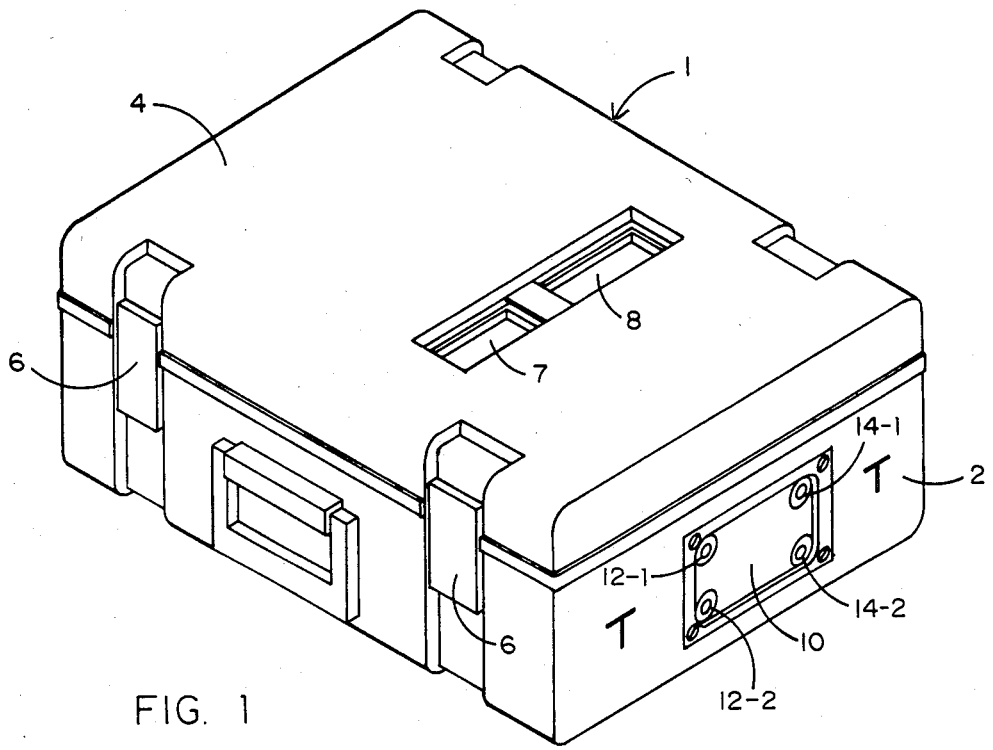
FIG. 1 is a perspective view of the carrying case which houses the golf swing training and practice device of the present invention.
Figure 2:
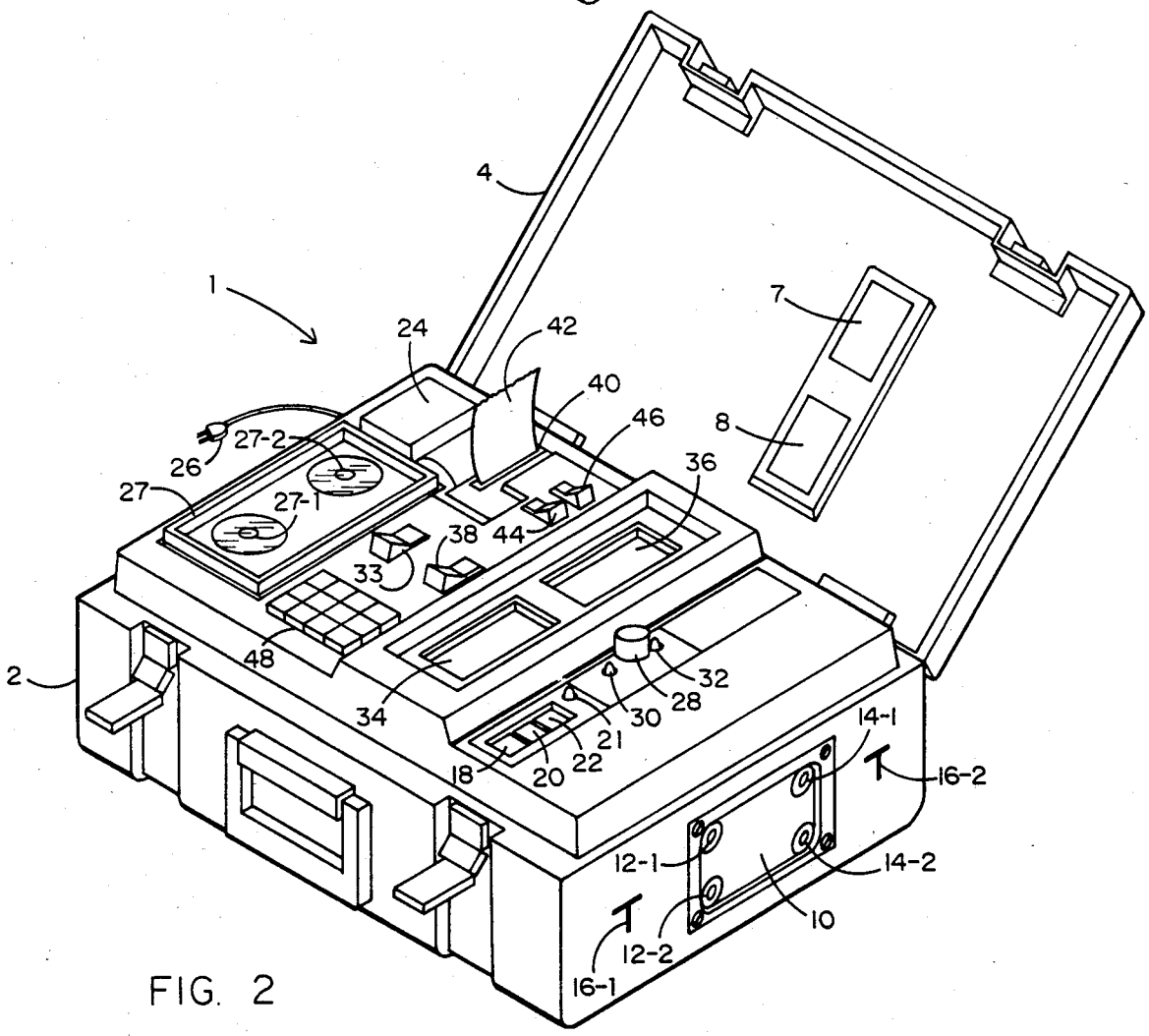
FIG. 2 shows the carrying case of FIG. 1 with a cover of the case raised to the opened position to expose the control panel of the present training and practice device.

The golf swing training and practice device which forms the present invention is now described while referring initially to FIGS. 1 and 2 of the drawings. FIG. 1 shows a carrying case 1 in which the training and practice device is housed. As a substantial improvement over conventional training and practice devices, the present training and practice device is both compact (i.e. fully self-contained within the carrying case 1) and relatively lightweight, whereby the presently disclosed device may be conveniently stored or easily transported from place to place. The portable nature of the present golf swing training and practice device is also of particular advantage to facilitate use in and out-of-doors.

The carrying case 1 may be fabricated from any suitable material, such as, for example, a high impact plastic. Case 1 includes a base 2 and a cover 4. First ends of the base 2 and cover 4 are pivotally connected together by conventional means (not shown) so as to permit the cover 4 to be rotated between closed (FIG. 1) and opened (FIG. 2) positions. The other ends of the base 2 and cover 4 include respective, well known latch means 6 that are adapted to be releasably interconnected together, so that the cover 4 may be closed atop base 2. Cover 4 also includes a pair of windows 7 and 8 formed therein, whereby to permit the golfer to have access to information provided by the present golf swing training and practice device with cover 4 in the closed position of FIG. 1.

Located at one side of base 2 is a transparent cover plate 10 behind which are positioned two recessed pairs of photodetectors 12-1, 12-2, and 14-1, 14-2, the details of which will be explained hereinafter. Briefly, however, photodetector 12-1 is positioned in vertical alignment with photodetector 12-2, and photodetector 14-1 is positioned in vertical alignment with photodetector 14-2. The distance (e.g. approximately three inches) between the vertically aligned pairs of photodetectors 12-1, 12-2, and 14-1, 14-2 defines a measuring zone through which the golfer swings the head of his golf club to provide input data to the present practice and training device. Suitable indicia 16-1 and 16-2 is marked on the side of base 2 adjacent cover plate 10, so as to indicate the preferred golf ball alignments for right and left-handed golfers, respectively.

In FIG. 2 of the drawings, the cover 4 of carrying case 1 is raised to the opened position to expose the control panel of the present golf swing practice and training device. The control panel includes on and off (e.g. pushbutton) switches 18 and 20 which are selectively operated to either provide power to or deactivate the practice and training device. An adjacent indicator lamp 21 is illuminated whenever switch 18 is operated to cause power to be delivered to the device. Another (e.g. pushbutton) switch 22 is operated when it is desirable to charge a self-contained battery supply (not shown). Batter power is particularly advantageous to permit the present device to be used at a remote or out-of-doors location, such as at the beach, on a lawn, at a driving range, or on a fairway. In order that the battery supply may be recharged after extended use, a battery charger 24 is disposed within a compartment formed at the control panel. A commercially available battery charger which is suitable for use herein is part No. 38H3 manufactured by Ault Corporation. Input terminals of the battery charger 24 are interfaced with a power cord 26 which can be connected to a 115 volt AC source at an available wall receptacle, or the like. Output terminals of the battery charger 24 are arranged to be interfaced with the battery supply (e.g. a pair of commercially available 6-volt batteries located below the control panel) when the charger is disposed within its compartment.

Although the photodetectors 12-1, 12-2, 14-1, and 14-2 may be responsive to ambient light conditions, a light supply 27 is preferred as a stable light source for all other conditions of operation. Light supply 27 is disposed within another compartment formed at the control panel. Light supply 27 is battery powered (e.g. by a single 6-volt battery) and includes a pair of incandescent bulbs 27-1 and 27-2 which are capable of providing substantially continuous and uniform illumination of the photodetectors. The bulbs 27-1 and 27-2 are spaced three inches apart and are surrounded by conventional reflectors. Light supply 27 has input terminals which are adapted to be interfaced with complementary output terminals of the battery charger 24 when light supply 27 is disposed within its compartment. Thus, when recharging switch 22 is operated with battery charger 24 and light supply 27 located in their respective compartments, the batteries of both the supply 27 and the present training and practice device can be simultaneously recharged. Battery charger 24 is disconnected from such batteries whenever either of the on or off switches 18 or 20 is otherwise operated.

In order to conserve battery power, the light supply 27 includes a timer circuit by which to limit the time during which bulbs 27-1 and 27-2 are lighted. More particularly, bulbs 27-1 and 27-2 will be lighted for a predetermined time (e.g. greater than ten seconds but less than thirty seconds) each time the golfer activates light supply 27 to illuminate the photodetectors 12-1, 12-2, 14-1, and 14-2. In this way, the battery of light supply 27 will not be consumed during periods of inactivity, when the golfer is not interested in collecting information regarding his golf swing. A commercially available timer circuit which is suitable for use by light supply 27 is microelectronic chip No. LM555CN manufactured by Texas Instruments Corporation.

The responsiveness of photodetectors 12-1, 12-2, 14-1, and 14-2 to the intensity of the light signals supplied thereto by light supply 27 is dependent upon the distance between the photodetectors and light supply (e.g. preferably between twelve to eighteen inches). Once the light supply 27 has been suitably positioned relative to the photodetectors, the detector circuitry (illustrated in FIG. 6) with which the photodetectors are associated must be adjusted for such distance. To this end, a rotatable knob 28, which adjusts an associated potentiometer, or the like, is included to align the detector circuitry with the respective optical responses of photodetector pairs 12-1, 12-2 and 14-1, 14-2. As will be explained in greater detail when referring to FIG. 6, knob 28 may be rotated in either direction to achieve the proper detector circuit alignment. Associated with alignment knob 28 is a pair of indicator lamps 30 and 32. One of the indicator lamps 30 or 32 will be illuminated whenever the detector circuitry is not in alignment with the photodetector response. When the alignment knob 28 is suitably positioned and the optical response of the photodetector pairs are aligned with the detector circuitry, neither one of the lamps 30 or 32 will be illuminated.

A switch 33 is provided at the control panel by which to indicate whether the golfer is right or left handed. Moving switch 33 to the right or left-handed switch positions conditions the pairs of photodetectors 12-1, 12-2 and 14-1, 14-2 (in a manner to be hereinafter described) to be responsive to the movement of a club head in particular directions through the measuring zone corresponding to a golfer's backswing and downswing.

The control panel includes a pair of digital displays 34 and 36 by which to provide to the golfer information regarding his golf club swing. The speed at which the golf club strikes the ball should be controlled depending upon the club used and the distance to a target. Therefore, the speed at which the golfer swings his club head through the measuring zone (as defined by the distance between the pairs of photodetectors 12-1, 12-2 and 14-1, 14-2) is indicated, in miles per hour, by a first digital display 34. In addition to speed control, a golfer's performance may also be improved or perfected by varying his backswing. That is, it is often necessary for the golfer to coil up on his backswing and not rush his downswing. Hence, the total elapsed time spent by a golfer to complete his swing (i.e. from the start of a backswing until impact is made with a golf ball during the downswing) is indicated, in (hundredths of) seconds, by the second digital display 36. Displays 34 and 36 are located in the vicinity of the measuring zone, so that the golfer will not have to move his head or body to read the information being provided therefrom. Accordingly, by virtue of the information displayed by the present golf swing and training and practice device, a golfer will be able to compare and correlate his club head speed (at display 34) with his total swing time (at display 36).

It was earlier disclosed that a pair of windows 7 and 8 are formed in the cover 4 of carrying case 1. The positions of windows 7 and 8 are particularly selected to be in alignment with displays 34 and 36. In this way, the cover 4 can be moved to the closed position (of FIG. 1), but the golfer will still be able to read the information supplied to him from displays 34 and 36 by way of windows 7 and 8.

A switch 38 is provided at the control panel by which to enable the golfer to clear the information supplied by displays 34 and 36. That is, by operating the switch 38 (e.g. in the event of an error during the golfer's entry of input data or when the information displayed is no longer needed), the golfer simultaneously blanks the displays 34 and 36 so that new information may be subsequently displayed.

In addition to a display of the golfer's club head speed and elapsed swing time, as provided by digital displays 34 and 36, the control panel also includes a printer 40. Therefore, the present golf training and practice device includes a pair of indicating means (i.e. the two displays and the printer) by which the golfer can obtain both a temporary and permanent record of his club head speed and swing time. Printer 40 may be a conventional dot matrix impact printer, such as part No. 150 manufactured by Epson Corporation that prints indicia (which, for example, is indicative of the current date, the type of golf club being used, the golfer's club head speed and swing time) on a paper tape 42. Accordingly, the golfer may tear off suitable portions of paper tape 42, so as to compile a history of his performances for review. A first switch 44 is associated with printer 40 so as to control the activation thereof. In the event that the golfer is not desirous of obtaining a permanent record of his performance, he may deactivate printer 40 by moving switch 44 to an appropriate switch position. However, with switch 44 positioned so as to deactivate printer 40, the golfer must rely solely on the digital displays 34 and 36 in order to obtain a temporary indication of his golf club head speed and swing time. A second switch 46 is associated with printer 40 and the paper tape drive thereof. Switch 46 is operated in order to cause the supply of tape 42 to be advanced, so that the golfer may conveniently gain access to the information printed thereon.

A (e.g. twelve button) keyboard 48 is also included at the control panel and interfaced with printer 40 (by way of a microcomputer 74 of FIG. 5), so that the golfer might record certain data. By way of example, data which can be recorded by way of keyboard 48 includes the day, month, and year and the type of club with which the golfer wishes to practice. Such data is then printed by printer 40 along with the golfer's club head speed and swing time. In this manner, the golfer is provided with a complete and permanent record of his performance, the results of which may be easily compared with the results obtained from prior and subsequent practice sessions, whereby the golfer will be able to monitor the stages of improvement and attempt to maximize the consistency of his golf club swing.

Figure 3:
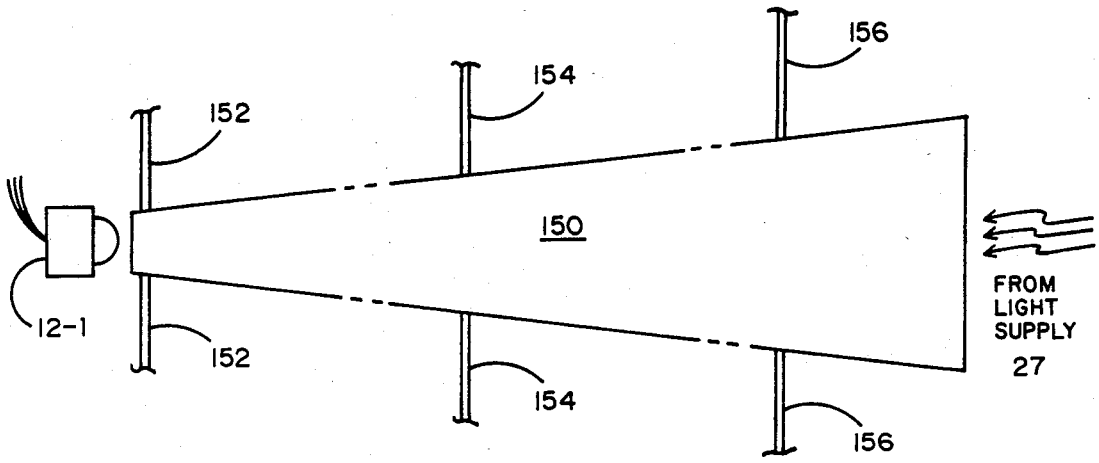
FIG. 3 is illustrative of a light trap configuration that is arranged ahead of each of the photodetectors of the present training and practice device.

In order to maximize the accuracy of the information which is indicative of the golfer's swing, a series of light traps is located in the respective optical paths between the cover plate 10 of carrying case 1 and each of the recessed photodetectors 12-1, 12-2, 14-1, and 14-2. Reference is now made to FIG. 3 of the drawings so that such light traps may be described in greater detail.

It has been found that if a photodetector were located at the end of a smooth bore tube, ambient (e.g. sun) light reflected from the golfer's club head could interfere with detecting the movement of the club head. As will soon be described, the golfer swings his club between the light supply 27 and the pairs of photodetectors 12-1, 12-2, and 14-1, 14-2. Movement of the golfer's club head in front of a photodetector interrupts the supply of light to that detector and causes an electrical signal to be generated. However, in bright sunlight conditions, or the like, light could be reflected from the club head into the opened end of and through a smooth bore tube. Thus, instead of blocking the supply of light to the photodetector, the club head could reflect sunlight to the detector so that movement of the club head therepast would go undetected.

The light traps of FIG. 3 substantially reduce the possible reflection of ambient (e.g. sun) light from the club head to the photodetectors, whereby to increase both the sensitivity of the photodetectors and the accuracy of the information provided by the present training and practice device. More particularly, each optical path 150 ahead of a recessed photodetector (e.g. 12-1) is provided with a series of (e.g. three) light traps. In general terms, each light trap comprises a thin, non-reflecting (e.g. molded plastic) plane having an aperture formed therein by which to pass incident light from light supply 27.

By way of example, the first light trap 152 is located approximately 0.25 inches in front of the photodetector 12-1. Light trap 152 has a circular aperture formed therein with a diameter of 0.160 inches (corresponding to the diameter of photodetector 12-1). The second light trap 154 is located approximately 1.1 inches ahead of the first light trap 152. Light trap 154 has a rectangular aperture formed therein with a height of 0.260 inches and a width of 0.160 inches. The third light trap 156 is located approximately 1.1 inches ahead of the second light trap 154 (i.e. 2.45 inches in front of photodetector 12-1). Light trap 156 also has a rectangular aperture formed therein with a height of 0.440 inches and a width of 0.160 inches. similar light traps are associated with photodetectors 12-2, 14-1, and 14-2.

By virtue of the present improvement, the conventional smooth bore tube is replaced by a tapered optical path 150 having dimensions which are defined by the apertures formed in light traps 152, 154, and 156. Incident light from light supply 27 passes unimpeded through the optical path 150 to photodetector 12-1. However, the path of most ambient light which is reflected from a golfer's club head into optical path 150 is intercepted and blocked by one of the light traps. Accordingly, only light from light supply 27 will reach the photodetectors when information is collected regarding the golfer's swing.

Figure 4:
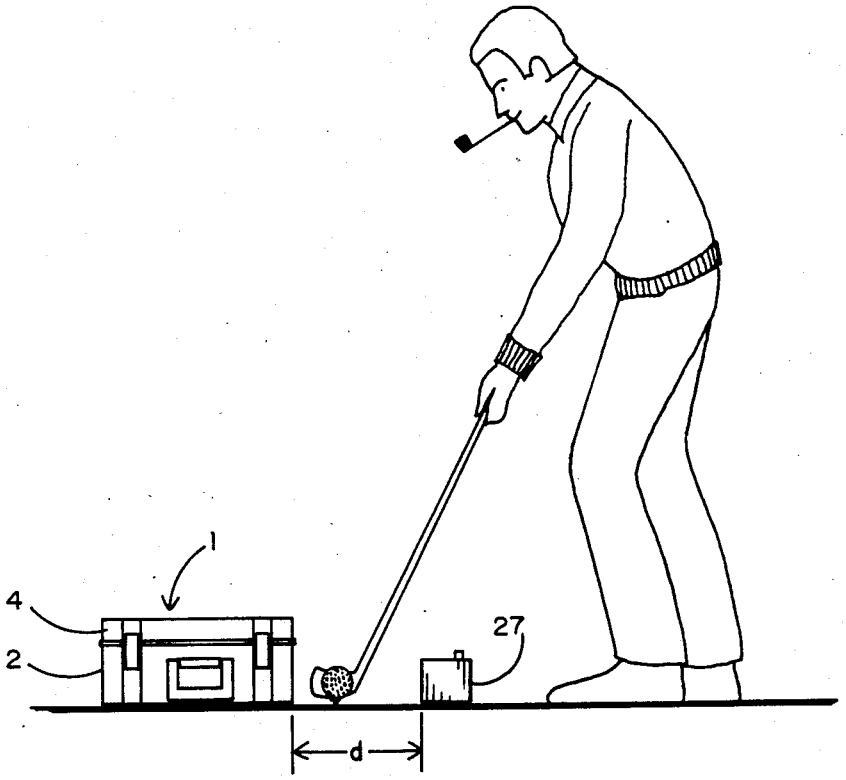
FIG. 4 illustrates the use by a golfer of the present training and practice device.

FIG. 4 of the drawings shows a golfer utilizing the presently disclosed golf swing training and practice device. In the embodiment of FIG. 4, the cover 4 of carrying case 1 is moved to the closed position, so that the golfer must read information provided by the digital displays 34 and 36 through the windows 7 and 8. However, prior to closing the cover 4 atop the control panel of case 1, and referring concurrently to FIGS. 2 and 4, the golfer initially operates switch 18 to energize the training and practice device. Light supply 27 is positioned in spaced alignment with and at a distance d (between twelve to eighteen inches) from the photodetector cover plate 10. The lamps of the light supply are energized for a predetermined time (by means of operating a momentary switch) to illuminate photodetectors 12-1, 12-2, 14-1, and 14-2. The alignment knob 28 is then rotated so that both indicator lamps 30 and 32 are extinguished, whereby the optical response of the photodetector pairs 12-1, 12-2, and 14-1, 14-2 is properly aligned with the detector circuitry for the particular optical signal intensity. The switch 32 is moved to a particular position depending upon whether the golfer is right or left-handed. Should the golfer desire a permanent record of his performance the printer switch 44 is operated to activate printer 40. The golfer is then free to enter at keyboard 48 numeric input data, so that a record of such data will appear with the printout on paper tape 42.

The golfer places a golf tee and/or a golf ball at either the right or left-handed ball positions between auxiliary light supply 27 and one of the markings 16-1 or 16-2 (best illustrated in FIG. 2) at the side of case 1. It is to be understood that the golfer may also use a sponge practice ball or no ball at all. The golfer begins his backswing in a first direction through the measuring zone between the photodetector pairs 12-1, 12-2 and 14-1, 14-2 and completes his downswing in an opposite direction through the measuring zone until impact is made with the golf ball. The golfer's club head speed in the downward direction through the measuring zone just prior to impacting the golf ball is recorded by printer 40 and/or displayed through window 7. The total elapsed time for the golfer to complete his backswing and downswing in opposite directions through the measuring zone is also recorded by printer 40 and/or displayed through window 8. At his option, the golfer may than operate switch 38 so as to clear the displays 34 and 36 and thereby permit additional data to be entered, recorded, and/or displayed in the manner described above.

Figures 5, 6:
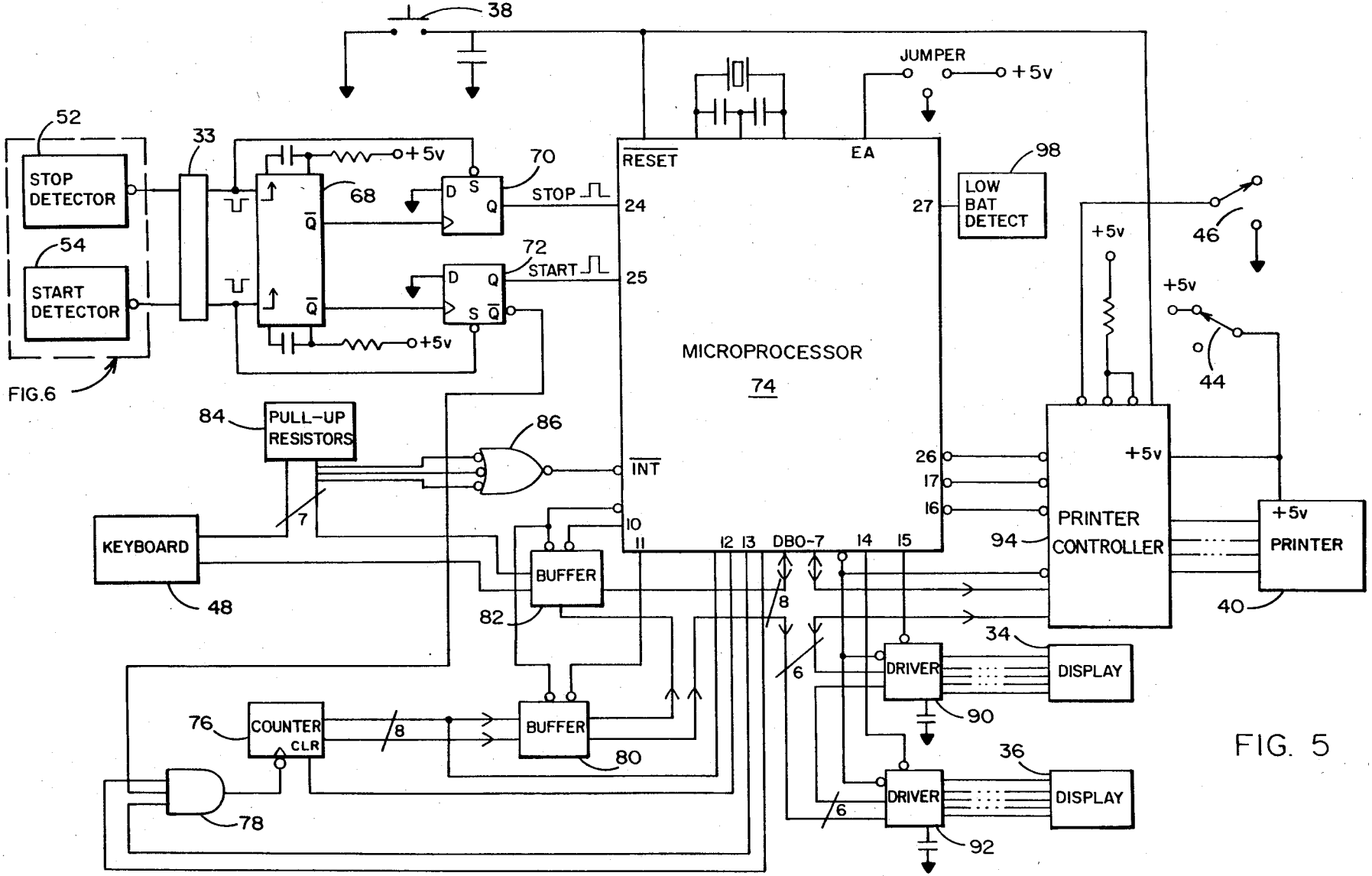
FIG. 5 is a block diagram of a preferred electronic system to implement the present training and practice device.
FIG. 6 is a block diagram detailing the photodetector arrangement of the system of FIG. 4.
Figure 6:
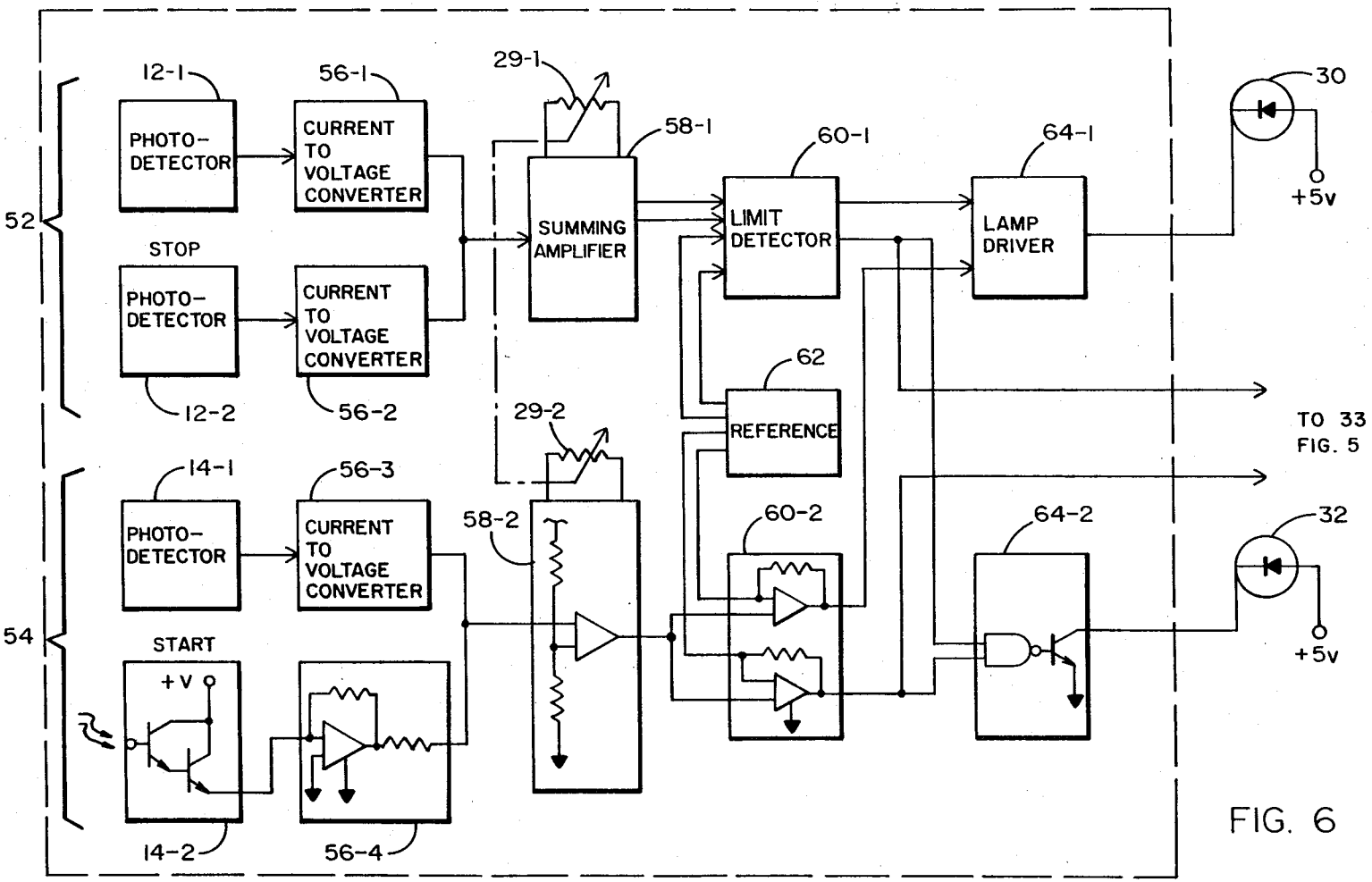

The detector circuitry by which to collect input data regarding the golfer's club head speed and swing time so that an indication thereof can be provided at displays 34 and 36 and printer 40 is now disclosed while referring to FIG. 5 of the drawings. The detector circuitry includes TTL compatible stop and start detectors 52 and 54. Stop and start detectors 52 and 54 are responsive to the movement of a golf club head through the measuring zone in opposite directions indicative of a backswing and downswing in a particular order corresponding to the swing of a right or left-handed golfer. The details of stop and start detectors 52 and 54 are best described while referring to FIG. 6 of the drawings.

In FIG. 6, one of the detectors (e.g. 52) is designated the stop detector, and the other detector (e.g. 54) is designated the start detector. This alignment is typical for a right-handed golfer. However, the stop-start functions performed by detectors 52 and 54 would be reversed in the event that the golfer is left-handed and the switch 33 at the control panel of FIG. 2 is positioned to indicate such a left-handed golfer. Each detector 52 and 54 includes a pair of the aforementioned, vertically aligned photodetectors 12-1, 12-2 and 14-1, 14-2. The vertical alignment of the photodetectors is advantageous to permit detectors 52 and 54 to sense all golf club swings through the measuring zone, regardless of arc or the distance between the club head and the ground. By way of example, each photodetector 12-1, 12-2, 14-1, and 14-2 may be an identical, commercially available phototransistor, such as part No. MRD360 manufactured by Motorola Corporation. The phototransistors operate as current sources when illuminated with light provided by light supply 27.

An output terminal of each phototransistor is connected to an input terminal of a respective current-to-voltage converter 56-1, 56-2, 56-3, and 56-4. The current-to-voltage converters may be a commercially available quad operational amplifier, such as part No. LM324A manufactured by National Semiconductor Corporation. Converters 56-1, 56-2, 56-3, and 56-4 provide output voltage signals which are proportional to current input signals supplied thereto from phototransistors 12-1, 12-2, 14-1, and 14-2. The magnitude of any such output voltage signals will decrease in the event that a golfer's club interrupts the light provided by supply 27 to either pair of phototransistors.

Output terminals of current-to-voltage converters 56-1 and 56-2 are connected together at one terminal of a summing amplifier 58-1. A second input terminal of summing amplifier 58-1 is interfaced with a (e.g. 50k) potentiometer 29-1 by which the gain of amplifier 58-1 may be adjusted. The resistance of the potentiometer 29-1 is set by means of rotating the alignment knob 28 which is located at the control panel illustrated in FIG. 2. Summing amplifier 58-1 provides an output signal corresponding to the sum of the voltage gain selected with potentiometer 29-1 and the voltages supplied from current-to-voltage converters 56-1 and 56-2 Output terminals of current-to-voltage converters 56-3 and 56-4 are connected together at one input terminal of a summing amplifier 58-2. A second input terminal of summing amplifier 58-2 is interfaced with a potentiometer 29-2 by which the gain of amplifier 58-2 may be adjusted when alignment knob 28 is rotated. Summing amplifier 58-2 provides an output signal corresponding to the sum of the voltage gain selected with potentiometer 29-2 and the voltages supplied from current-to-voltage converters 56-3 and 56-4. Summing amplifiers 58-1 and 58-2 may be a commercially available quad operational amplifier, such as part No. LM324A manufactured by National Semiconductor Corporation.

The output terminals of summing amplifiers 58-1 and 58-2 are respectively connected to first and second input terminals of a pair of voltage limit detectors 60-1 and 60-2. Third and fourth input terminals of each of voltage limit detectors 60-1 and 60-2 are connected to receive a pair of output signals from a source of reference voltages 62. Each of voltage limit detectors 60-1 and 60-2 may be a single, commercially available quad comparator, such as part No. LM339A manufactured by National Semiconductor Corporation. The source of reference voltages 62, which provides predetermined output voltage signals, may be a resistor-voltage divider network connected to a 5-volt power source (not shown). The predetermined output voltage signals from the divider network establish upper and lower limit reference voltages. The reference voltages may be buffered by a commercially available quad operational amplifier (also not shown), such as part No. LM324A manufactured by National Semiconductor Corporation. As will be understood by those skilled in the art, limit detector 60-1 functions to compare the output voltage signal supplied by summing amplifier 58-1 with the upper and lower limit reference voltages supplied by voltage source 62. Limit detector 60-2 functions to compare the output voltage signal supplied by summing amplifier 58-2 with the upper and lower limit reference voltages supplied by reference voltage source 62. The lower limit reference voltage is selected to correspond to a particular minimum optical intensity to which the detector circuitry is responsive while remaining sensitive to the movement of a golfer's club through the measuring zone. Likewise, the upper limit reference voltage is selected to correspond to a particular maximum optical intensity to which the detector circuitry is responsive. Thus, the lower and upper limit reference voltages of voltage source 62 establish a range of operating voltages, and limit detectors 60-1 and 60-2 provide an indication whether the respective output voltage signals from summing amplifiers 58-1 and 58-2 lie within such voltage range.

First and second output terminals of each of level detectors 60-1 and 60-2 are respectively connected to a corresponding input terminal of each of a pair of lamp drivers 64-1 and 64-2. However, it is to be understood that the pair of lamp drivers 64-1 and 64-2 may be packaged as a single commercially available device, such as part No. 75451 manufactured by Texas Instruments Corporation. Such a device typically includes two halves, each half of which being connected to receive output signals from both level detectors 60-1 and 60-2. One of such output terminals from each level detector 60-1 and 60-2 represents respective output terminals of the stop and start detectors 52 and 54 (which are connected to start-stop latch circuitry of FIG. 5).

An output terminal from each lamp driver 64-1 and 64-2 is connected to a respective indicator lamp 30 and 32. Both of the indicator lamps 30 and 32 are extinguished when the intensities of the optical signals detected by the pairs of phototransistors 12-1, 12-2, and 14-1, 14-2 lie between the upper and lower limits corresponding to the predetermined first and second voltage levels provided by reference source 62 to level detectors 60-1 and 60-2. One of the lamps 30 or 32 is illuminated when the intensity of the input optical signals to the phototransistors 12-1, 12-2, 14-1, and 14-2 falls below the aforementioned lower limit. By way of example, the first lamp will be illuminated if the light source 27 is too far away from the phototransistors or if the optical path to the phototransistors is blocked. The golfer may extinguish this first lamp by either moving the light supply 27 closer to the phototransistors or rotating the alignment knob 28, so as to increase the gain of summing amplifier 58-1. The other of the lamps 30 or 32 is illuminated if the intensity of the input optical signals exceeds aforementioned upper limit. Such other lamp will be illuminated if the light supply 27 is too close to the phototransistors. The golfer may extinguish this other lamp by either moving the light supply 27 away from the phototransistors or rotating the alignment knob 28, so as to decrease the gain of summing amplifier 58-2.

Referring once again to FIG. 5 of the drawings, the output terminals of stop and start detectors 52 and 54 are connected to the switch 33 by which to indicate whether the golfer is right or left handed. A pair of output terminals of switch 33 are connected to respective input terminals of a dual one shot multivibrator 68. The output signals supplied by detectors 52 and 54 are typically pulses, the widths of which depend upon the length of time during which a golfer's club head is positioned in front of a pair of phototransistors (12-1, 12-2 or 14-1, 14-2 of FIG. 6). The magnitude of such output pulses undergoes a transition between voltage levels (e.g. 5 volts and ground) whenever the golfer's club head interrupts the light supply to a phototransistor pair. Multivibrator 68 may be a commercially available microelectronic chip, such as part No. 96L02 manufactured by Fairchild Corporation. The output terminals of stop and start detectors 52 and 54 are also connected to respective first input terminals (designated S) of a pair of flip-flops 70 and 72. Output terminals (designated $\overline{Q}$) of multivibrator 68 are connected to respective second input terminals of flip-flops 70 and 72. Flip-flops 70 and 72 may be identical, commercially available microelectronic chips, such as part No. 74HC74 manufactured by National Semiconductor Corporation. Multivibrator 68 and flip-flops 70 and 72 form both a latch and anti-glitch circuit for the output pulses supplied thereto by detectors 52 and 54. That is, a very slow movement of a golfer's club head past the pairs of phototransistors and/or the use of a modulated light source might cause an oscillation or chatter at the edge of a pulse during a transition between voltage levels. The multivibrator 68 delays the response to this transition, such that pulses generated at the output terminals of flip-flops 70 and 72 will be devoid of any oscillation or chatter that might otherwise be present at the edges of pulses being supplied to the input terminals of multivibrator 68.

First output terminals (designated Q) of each flip-flop 70 and 72 are connected to respective input terminals of a microprocessor 74. Microprocessor 74 may be a commercially available microelectronic chip, such as part No. 8748 manufactured by Intel Corporation, which is driven by a 3 MHz crystal. Microprocessor 74 receives the output pulses (designated STOP and START) which are respectively produced by flip-flops 70 and 72 (and indicative of stop and start conditions corresponding to either a practice waggle or a full swing). Microprocessor 74 is programmed to distinguish between such a practice waggle and an intended swing. For example, a golfer's preparatory waggle might result in the movement of his club head through the measuring zone and in front of the pairs of phototransistors. In this case, the microprocessor would receive input data regarding the practice waggle rather than an intended swing. As will soon be explained, microprocessor 74 is also programmed to compute the elapsed time between the receipt of sequentially produced output signals from flip-flops 70 and 72, so that in the event of an actual backswing and downswing past the pairs of phototransistors, the golfer's swing time and club head speed can be reliably computed, printed and/or displayed.

A second output terminal (designated $\overline{Q}$) of flip-flop 72 is interconnected with a high speed microprocessor controlled counter 76 by way of a 3-input OR gate 78. Counter 76 may be a commercially available microelectronic chip, such as part No. 74HC393 manufactured by National Semiconductor Corporation. A pair of control terminals of microporcessor 74 are also interconnected with counter 76 by way of OR gate 78. Thus, the operation of counter 76 can be controlled according to the software program of microprocessor 74 in a manner to be described hereinafter when referring to FIG. 8. Briefly, however, the counter 76 provides an indication of the golfer's elapsed swing time between the generation of certain output pulses by flip-flops 70 and 72. Control signals provided from microprocessor 74 (by way of OR gate 78) initiate the operation of counter 76 at the beginning of the golfer's backswing (i.e. past start detector 54 in a first direction). An output pulse provided from the second output terminal ($\overline{Q}$) of flip-flop 72 (by way of AND gate 78) terminates the operation of counter 76 at the conclusion of the golfer's downswing (i.e. past start detector 54 in an opposite direction). A control signal from microprocessor 74 is supplied to an input terminal (designated CLR) of counter 76, so as to clear the counter 76 to receive additional information regarding the golfer's club head speed (i.e. between start and stop detectors 54 and 52 at the end of the downswing).

Output terminals of counter 76 (which provide signals indicative of the time counted thereby) are connected via a (e.g. eight line) data bus to one of a pair of data bus buffers 80. Output terminals of the keyboard 48 (of FIG. 2) are interfaced with respective pull-up resistors 84 and connected via a (e.g. seven line) data bus to the second of the data bus buffers 82. Pull-up resistors 84 are particularly selected to establish suitable logic levels for the keyboard 48. Each of data bus buffers 80 and 82 may be an identical, commercially available microelectronic chip, such as part No. 74C941 manufactured by National Semiconductor Corporation. Pairs of control terminals of microprocessor 74 are connected to respective input terminals of buffers 80 and 82, so that the operations of such buffers can be controlled according to the software program of the microprocessor. Whenever a keyboard key is depressed (such as when the golfer wishes to enter coded data corresponding to the date and/or type of golf club), an interrupt signal is supplied via a 3-input AND gate 86 to an input terminal (designated $\overline{INT}$) of microprocessor 74. Such an interrupt signal conditions the microprocessor to read the input data being supplied thereto from keyboard 48. More particularly, the input data representative of a keyboard key is supplied by way of data bus buffer 82 and an (e.g. eight line) data bus to a series of eight data terminals (designated DB0–7) of microprocessor 74. What is more, input data indicative of the count of counter 76 is supplied by way of data bus buffer 80 and the aforementioned data bus to the same data terminals (DB0–7) of the microprocessor 74.

Microprocessor 74 is also interfaced with a pair of display drivers 90 and 92 so that the displays 34 and 36 (best described when referring to FIG. 2) can be energized and supplied with accurate information regarding a golfer's swing. More particularly, microprocessor 74 is connected by way of a (e.g. 6 line) data some of data terminals DB0–7 to respective input terminals of each of display drivers 90 and 92. A pair of control terminals of microprocessor 74 are connected to respective other input terminals of display drivers 90 and 92 so that the operation of such drivers may be controlled by the software program of the microprocessor. Each display driver may be an identical commercially available microelectronic chip, such as part No. 7211AM manufactured by Intersil Corporation. Output terminals of each display driver 90 and 92 are interconnected with a respective digital display 34 and 36, so that the input data provided to microprocessor 74 by counter 76 can be converted into output information indicative of the golfer's club head speed and swing time and supplied to displays 34 and 36 via respective display drivers 90 and 92. Each display 34 and 36 may be an identical 3½ digit liquid crystal display, such as part No. 5655 manufactured by IEE Company of Burbank, Calif. Such displays may be easily read by a golfer in bright daylight conditions.

In order that the printer 40 (best described when referring to FIG. 2) might also be supplied with information regarding a golfer's swing, microprocessor 74 is interconnected with printer 40 by way of a printer controller 94. Printer controller 94 may be a commercially available microelectronic chip, such as part No. 160 manufactured by Epson Corporation. More particularly, the same information supplied to display drivers 90 and 92 is also supplied from data terminals DB0–7 of microprocessor 74 via an (e.g. 8 line) data bus to respective input terminals of printer controller 94. Other control terminals of microprocessor 74 are connected to respective input terminals of printer controller 94 so that the operation thereof may be controlled by the software program of the microprocessor. Printer controller 94 is interconnected with the printer 40, so that output information indicative of the golfer's club head speed and swing time is supplied to printer 40 via controller 94. As earlier disclosed, printer 40 will print out such information whenever the golfer operates the associated printer switch 44. As also earlier disclosed, the golfer may operate a tape advance switch 46, which is electrically connected to printer controller 94, whereby to cause an advance of the paper tape on which is printed the information regarding the golfer's swing. Likewise, the aforementioned manual reset switch 38 at the control panel of FIG. 2 is electrically connected to input terminals of each of the microprocessor 74 and printer controller 94. Operation of the manual reset switch 38 by a golfer blanks the digital displays 34 and 36 and clears all registers (including counter 76) to receive additional data regarding a golfer's swing.

A commercially available battery voltage monitoring circuit 98 (such as part No. ICL8211CPA manufactured by Intersil Corporation) is also interconnected with microprocessor 74. Microprocessor 74 is programmed to cause a visual warning at one of the displays 34 or 36 in the event that the battery supply of the present training and practice device nears depletion.

The software program of the microprocessor 74 of FIG. 5 for controlling the operation of the present golf swing practice and training device is represented by the flow chart at FIG. 6 of the drawings. When the golfer operates the switch 18 at the control panel (of FIG. 2), power is supplied to the present device. The microprocessor 74 then executes a reset routine 100. During reset, both digital displays 34 and 36 are blanked and all internal and external registers (e.g. including counter 76) are cleared. Upon completion of the reset routine 100, the microprocessor executes a start/stop routine 102 (which is described in detail when referring to FIG. 8). Briefly, however, during start/stop, microprocessor 74 is responsive to STOP and START input pulses which are indicative of the golfer's movement of his golf club head through the measuring zone and in front of pairs of phototransistors 12-1, 12-2 and 14-1, 14-2 (i.e. at the stop and start detectors 52 and 54 of FIG. 6) by which the limits of the measuring zone are defined. Moreover, the microprocessor 74 distinguishes an actual golf swing from a preparatory waggle of the golfer's club through the measuring zone.

As previously disclosed, when referring to FIG. 5, the golfer may use keyboard 48 to enter certain input data (e.g. regarding the present date and type of club being used) at microprocessor 74 to be printed by the printer 40. Therefore, and as also previously disclosed when referring to FIG. 5, microprocessor 74 is responsive to a keyboard interrupt input signal which is generated whenever a keyboard key is depressed by the golfer. Microprocessor 74 executes a well known debounce operation 104 for each keyboard key which is depressed by the golfer. The data content of the key is then read and converted into coded information to be supplied to the printer 40. More particularly, and as also disclosed when referring to FIG. 4, the information provided by keyboard 48 is supplied during execution of a data transfer operation 106 to microprocessor data terminals (DB0–7) via data bus buffer 82 and then to printer 40 via printer controller 94 and/or to displays 34 and 36 via display drivers 90 and 92. Upon the completion of the operation 106 to transfer data from the keyboard 48, the microprocessor returns to seek a new instruction before performing the start/stop routine 102.

Figure 7:
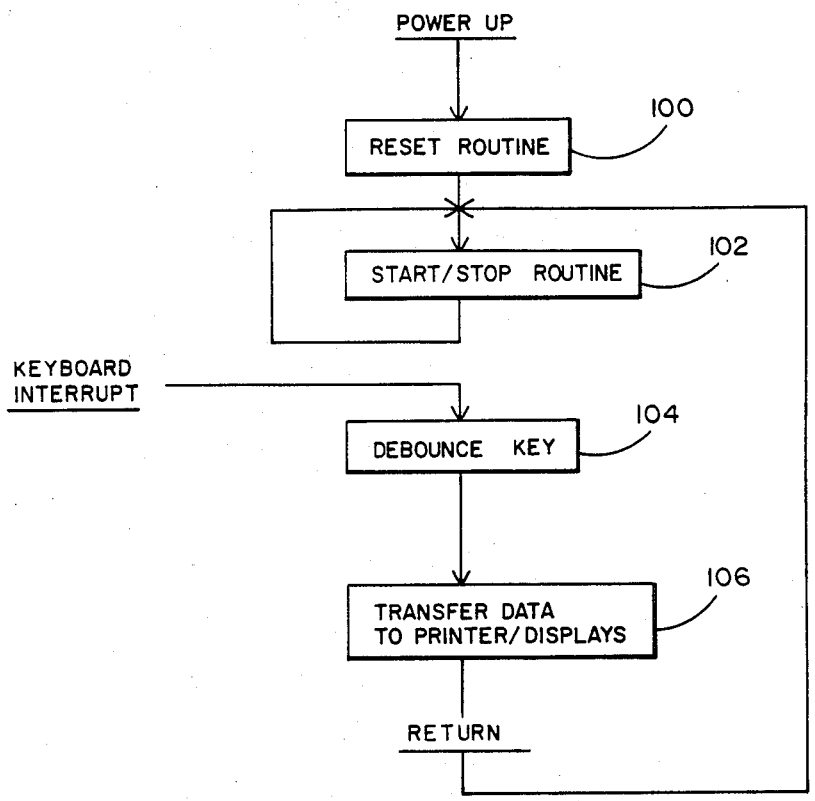
FIG. 7 represents a flow diagram of the software program by which the microprocessor of FIG. 4 controls the operation of the present training and practice device.
Figure 8:
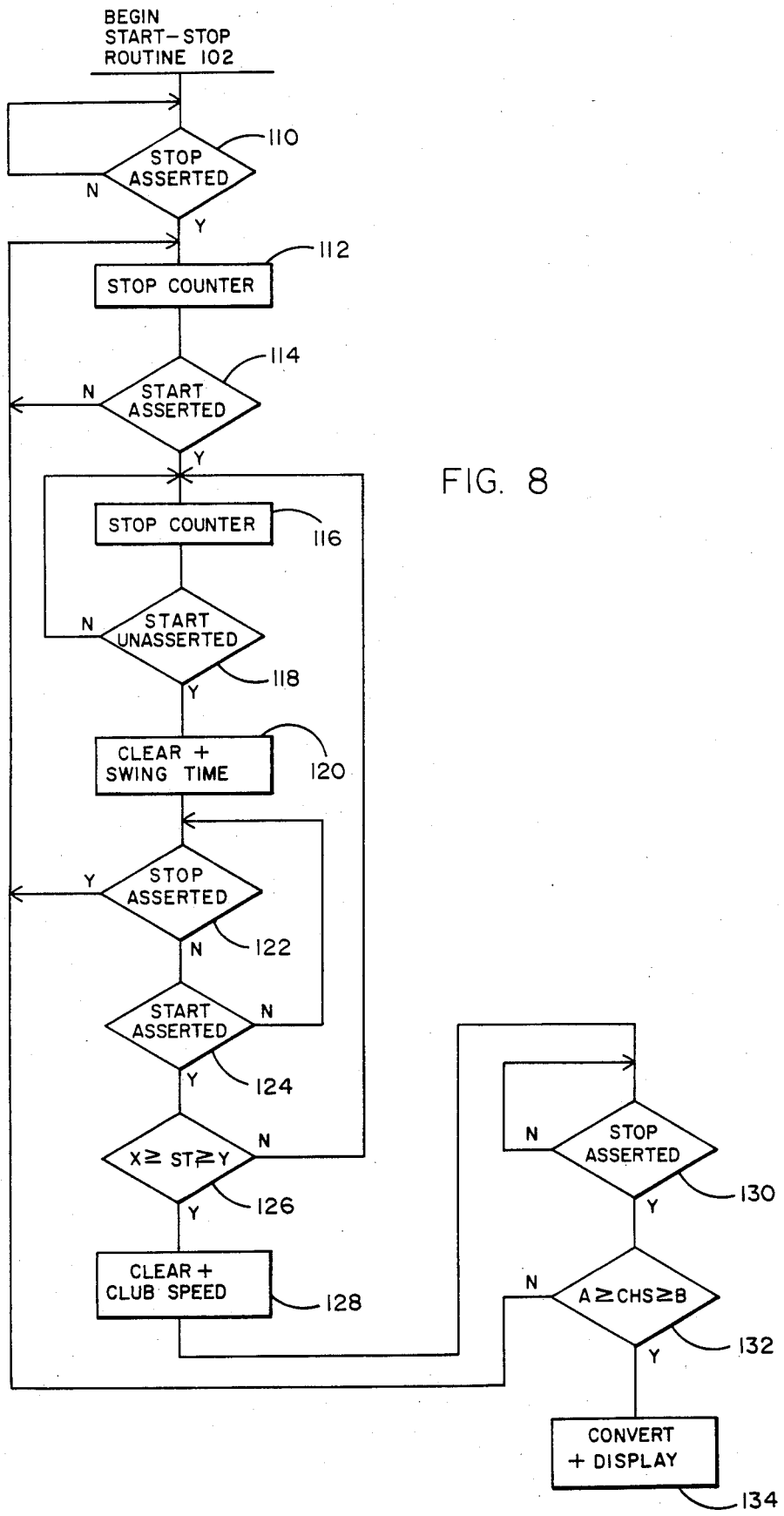
FIG. 8 represents a flow diagram of a particular routine of the software program represented in FIG. 6.

The start/stop routine 102 of FIG. 7, during which the present golf swing practice and training device senses input data and provides output information regarding a golfer's swing, is best described when referring concurrently to FIGS. 5 and 8 of the drawings. That is, after the present practice and training device is powered up (by operating switch 18 of FIG. 2) and the reset routine (100 of FIG. 7) is completed, the microprocessor 74 (of FIG. 5) enters the start/stop routine 102 of FIG. 8 and initially executes a decision step 110 to determine whether a STOP pulse has been asserted by flip-flop 70. A STOP pulse is asserted whenever the golfer's club head interrupts the light supply to the phototransistors (i.e. 12-1 and 12-2) which form stop detector 52 (such as when a right-handed golfer addresses a golf ball). If no STOP pulse is yet asserted, the microprocessor waits until such a STOP pulse is asserted.

Once a STOP pulse is asserted and detected, the microprocessor executes a control step 112 by which counter 76 is stopped and reset. The microprocessor then executes a decision step 114 to determine whether a START pulse has been asserted by flip-flop 72 after the earlier STOP pulse asserted by flip-flop 70. A START pulse is asserted whenever the golfer's club interrupts the light supply to the phototransistors (i.e. 14-1 and 14-2) which form start detector 54 (such as when the golfer moves his club in a first direction completely through the measuring zone during either of a practice waggle or a backswing). If a START pulse is detected after a STOP pulse, the microprocessor executes a control step 116 by which counter 76 is stopped and reset. If a START pulse is not asserted after a STOP pulse (such as during a practice waggle totally within the confines of the measuring zone), but two successive STOP pulses are otherwise asserted, the microprocessor re-executes control step 112 and again stops and resets counter 76.

In the event STOP and START pulses are asserted and detected in sequence, the microprocessor executes a decision step 118, to determine whether the START pulse is unasserted. A START pulse is unasserted or ended when the golfer's club head moves away from and unblocks the start detector 54. If the end of the START pulse is detected (corresponding to a transition in signal level), the microprocessor executes a control step 120, whereby counter 76 and internal microprocessor registers are cleared to begin a count and computation of swing time. The counter 76 then begins to count so that the golfer's total elapsed swing time can be computed. If the end of the START pulse is not detected (i.e. the golfer's club continues to interrupt the light supply to start detector 54), the microprocessor re-executes control step 116 until the START pulse is finally unasserted.

During a decision step 122, the microprocessor determines if another STOP pulse is asserted by flip-flop 70 after the preceding START pulse has been unasserted or ended. Another STOP pulse is asserted (after successive STOP and START pulses) when the golfer's club head is moved in a second and opposite direction through the measuring zone so as to interrupt the light supply to stop detector 52 (such as during a practice waggle when the club head fails to exit the measuring zone). In this case, and because information regarding a practice waggle is not relevant to the computation of club head speed and swing time, the microprocessor re-executes control step 112.

In the event that another STOP pulse is not asserted, the microprocessor executes a decision step 124 to determine if another START pulse is otherwise asserted by flip-flop 72. Another START pulse is asserted (after successive STOP and START pulses) when the golfer's club head is moved in the aforementioned second direction through the measuring zone so as to interrupt the light supply to start detector 54 (such as when the club head returns to the measuring zone after a previous exit during either a practice waggle or an intended backswing). In the event that another START pulse is not asserted, the microprocessor re-executes decision step 122. Another START pulse is not asserted when the golfer fails to return his club to the measuring zone after previously exiting the zone. In this case, the counter 76 continues to count and the microprocessor continues to wait until such a START pulse is asserted. In the event that the START pulse is asserted after successive STOP and START pulses (indicative of a return of the club head to the measuring zone), the microprocessor executes a decision step 126 to determine whether the exit from and subsequent reentry into the measuring zone was either a practice waggle or an intended back and downswing. To this end, the microprocessor is responsive to the swing time (corresponding to the time between the generation of successive START pulses) during which the golfer's club head exits and then reenters the measuring zone past start detectors 54. That is, if the swing time measured by counter 76 falls within a predetermined range of swing times between limits designated X and Y (such as, for example, 0.7 seconds and 10.0 seconds), such measurement is stored within the internal registers of the microprocessor as an indication of the elapsed time to complete a valid backswing and downswing. However, if the swing time measured by counter 76 falls outside the predetermined range, such measurement is discarded (as being indicative of an incomplete backswing or a late backswing or a relative large waggle), and the microprocessor re-executes control step 116.

In the event of a proper backswing and downswing in opposite directions through the measuring zone such that STOP, START, and START pulses are sequentially and timely generated by flip-flops 70 and 72, the microprocessor executes control step 128, whereby the counter 76 and internal microprocessor registers are cleared to begin a count and computation of club head speed. Club head speed is the speed at which the golfer moves his club head during the downswing through the measuring zone (i.e. between start and stop detectors 54 and 52). Therefore, the microprocessor executes decision stop 130 to determine whether another STOP pulse has been asserted (indicating the end of the downswing and a movement of the golfer's club head past stop detector 52). If another STOP pulse is not asserted, the counter 76 continues to count and the microprocessor waits until such a STOP pulse is asserted. In the event that the STOP pulse is asserted (after successive STOP, START, and START pulses), the microprocessor stops counter 76 and executes a decision step 132 to determine the validity of the golfer's downswing. To this end, the microprocessor is responsive to the time during which the golfer's club head passes through the measuring zone between the start and stop detectors 54 and 52. That is, if the time measured by counter 76 falls within a predetermined range of times between limits designated A and B (such as, for example, times corresponding to club head speeds of 10 and 142 miles per hour), such measurement is stored within the internal registers of the microprocessor as an indication of actual club head speed. However, if the club head speed falls outside the predetermined range, such measurement is discarded (as being indicative of an invalid downswing), and the microprocessor re-executes control stop 112.

In the event of a valid golf swing through the measuring zone such that STOP, START, START, and STOP pulses are sequentially and timely asserted, the microprocessor executes control step 134, whereby the information stored in the internal microprocessor registers regarding swing time and club head speed is converted into suitable language and printed by printer 40 and/or displayed by digital displays 34 and 36.

New information regarding a golfer's subsequent swing may be obtained by repositioning the club head in front of stop detector 54 and repeating the start-stop routine 102 of FIG. 8 in the manner just described.

It will be apparent that while a preferred embodiment of the invention has been shown and described, various modifications and changes may be made without departing from the true spirit and scope of the invention.

Having thus set forth a preferred embodiment of the present invention, what is claimed is:

1. A golf swing practice device for measuring the speed at which a golfer swings his club through a measuring zone, said practice device including at least two optical detectors, the respective optical axes of which define opposite ends of the measuring zone, means by which to supply said optical detectors with incident light, computational means interfaced with said optical detectors to measure the elapsed time for the golfer to swing his club through the measuring zone so as to obtain an indication of the speed at which the golfer swings his club therethrough, and detector circuitry interfaced with said optical detectors and comprising:

signal generating means interconnected with each of said optical detectors to generate output signals, the magnitudes of which are representative of the optical intensity of the incident light received by said optical detectors from said incident light supply means;

reference signal supply means providing first and second reference signals, the magnitudes of which are representative of minimum and maximum optical intensities in a predetermined range of optical intensities to which said optical detectors are responsive; and limit detector means connected to receive and compare the magnitudes of the first and second reference signals from said reference signal supply means with the magnitudes of the output signals provided by said signal generating means, said limit detector means providing an output signal indicative of whether the intensity of the incident light at said optical detectors is above, below or within the range of predetermined optical intensities established by said reference signal supply means.

2. The golf swing practice device recited in claim 1, wherein each of said optical detectors is a phototransistor.

3. The golf swing practice device recited in claim 1, wherein each end of the measuring zone is defined by a pair of optical detectors, said pair of optical detectors being arranged in vertical alignment with one another.

4. The golf swing practice device recited in claim 1, wherein said light supply means includes a light source which is arranged in spaced alignment with said optical detectors to supply incident light thereto, the golfer's club being swung between said light source and said optical detectors.

5. The golf swing practice device recited in claim 1, wherein said detector circuitry also comprises gain control means by which to provide an adjustable gain control signal to selectively adjust the sensitivity of said optical detectors to the incident light, and summing means connected between said signal generating means and said limit detector means to provide an output signal to said limit detector means which is indicative of the sum of the gain control signal and the signal generated by said signal generating means.

6. The golf swing practice device recited in claim 1, wherein said detector circuitry also comprises visual indicator means interconnected to receive the output signal from said limit detector means, said visual indicator means providing a visual warning whenever the intensity of the incident light at said optical detectors is outside the range of predetermined optical intensities established said reference signal supply means.

7. The golf swing practice device recited in claim 1, wherein said computational means has a high speed counter by which to count the elapsed time for the golfer to swing his club through the measuring zone.

8. The golf swing practice device recited in claim 7, wherein said computational means also has a micro-computer interconnected with each of said counter and said detector circuitry to control the operation of said counter depending upon the output signals provided by said detector circuitry.

9. The golf swing practice device recited in claim 8, further including display means interconnected with said micro-computer to provide a visual display of the speed at which the golfer swings his club through the measuring zone.

10. The golf swing practice device recited in claim 9, further including keyboard means interconnected with said micro-computer so that input data may be supplied to the micro-computer and displayed by said display means along with the golfer's club speed.

11. The golf swing practice device recited in claim 8, further including signal gating means interconnected between said detector circuitry and said micro-computer, said signal gating means being responsive after a particular time delay to the output signals provided by said limit detector means to supply an indication thereof to said micro-computer and to control the operation of said counter.

12. A golf swing practice device for measuring the speed at which a golfer swings has club through a measuring zone, said practice device including at least two optical detectors being recessed within said practice device, the respective optical axis of said detectors defining opposite ends of the measuring zone, means to be arranged in spaced alignment with said optical detectors to supply incident light thereto, and means positioned ahead of said recessed optical detectors to prevent light other than the incident light from said light supply means from reaching said optical detectors, said preventing means comprising a plurality of parallel aligned, non-reflecting planes located across the optical axis of each optical detector, each of said planes having a respective aperture formed therein to permit incident light from said incident light supply means to reach said optical detector along the optical axis thereof, the areas of the apertures decreasing in successive ones of said planes between said incident light supply means and said optical detector, such that a tapered optical path is formed through the apertures of said planes.

13. The golf swing practice device recited in claim 12, wherein the aperture formed in the non-reflecting plane located closest to said optical detector is circular and the apertures formed in the remaining non-reflecting planes are rectangular.

14. A golf swing practice device for indicating the elapsed time for a golfer to complete has swing and the speed at which the golfer swings his club through a measuring zone, said practice device comprising:

first and second optical detectors being separated from one another, the respective optical axies of said detectors defining opposite ends of the measuring zone;

means by which to supply said optical detectors with incident light;

first signal generating means interconnected with said first optical detector and generating a first output signal when a golfer addresses his golf ball by positioning his club in front of said first detector so as to interrupt the supply of light thereto;

second signal generating means interconnected with said second optical detector and generating a second output signal when a golfer starts his backswing by moving his club away from the first optical detector and past said second optical detector to interrupt the supply of light to said second detector;

counter means interconnected with said first and second signal generating means and operative in response to the sequential generation of said first and second output signals by said first and then said second signal generating means to begin a count of the golfer's swing time, said counter means operative in response to a third output signal from said second signal generating means following the sequential generation of said first and second output signals to end the count of the golfer's swing time when the golfer completes his downswing and again moves his club in front of the second optical detector to interrupt the supply of light to said second detector;

first register means connected to receive the count of said counter means between the sequential generation of said second and third output signals, whereupon the count of said counter means is restarted to compute the golfer's club head speed through said measuring zone, the count supplied to said first register means being indicative of the elapsed time for the golfer to complete his swing;

said counter means operative in response to a fourth output signal from said first signal generating means following the sequential generation of said first, second and third output signals to end the count of the golfer's club head speed at the completion of the downswing and when the golfer again moves his club in front of the first optical detector to interrupt the supply of light thereto; and second register means connected to receive the count of said counter means between the sequential generation of said third and fourth output signals, the count supplied to said second register means being indicative of club head speed through said measuring zone at the end of the downswing.

* * * * *